US008714080B2

(12) United States Patent
Shaw

(10) Patent No.: US 8,714,080 B2
(45) Date of Patent: May 6, 2014

(54) TRASH COMPACTING DEVICE

(76) Inventor: Al Shaw, Westampton, NJ (US)

( * ) Notice: Subject to any disclaimer, the term of this patent is extended or adjusted under 35 U.S.C. 154(b) by 407 days.

(21) Appl. No.: 13/181,813

(22) Filed: Jul. 13, 2011

(65) Prior Publication Data

US 2012/0012015 A1 Jan. 19, 2012

Related U.S. Application Data

(60) Provisional application No. 61/364,074, filed on Jul. 14, 2010.

(51) Int. Cl.
*B30B 15/06* (2006.01)
*B30B 1/00* (2006.01)
*B30B 9/30* (2006.01)

(52) U.S. Cl.
CPC ..... *B30B 9/3053* (2013.01); *B30B 9/3021* (2013.01)
USPC ..... 100/265; 100/233

(58) Field of Classification Search
USPC ..... 100/226, 227, 229 A, 230, 233, 265, 100/283, 295, 299; D7/682; D8/14, 77; D15/123; 404/133.05, 133.1
See application file for complete search history.

(56) References Cited

U.S. PATENT DOCUMENTS

| | | | | |
|---|---|---|---|---|
| D35,130 | S | 9/1901 | Allison | |
| 2,018,126 | A * | 10/1935 | Simms | 100/228 |
| 2,135,404 | A | 11/1936 | Lofstrand, Sr. | |
| 2,178,797 | A | 11/1939 | Vigne | |
| 3,285,505 | A | 11/1966 | Katz | |
| D206,926 | S | 2/1967 | Lurski | |
| 3,357,346 | A | 12/1967 | Crafoord | |
| 3,565,351 | A | 2/1971 | Ross, Jr. | |
| 3,835,769 | A | 9/1974 | Peterson | |
| 3,862,595 | A | 1/1975 | Longo | |
| 3,899,967 | A | 8/1975 | Powers | |
| 3,938,731 | A | 2/1976 | Ross, Jr. et al. | |
| 3,946,662 | A | 3/1976 | Ross, Jr. et al. | |
| 3,988,978 | A | 11/1976 | Flick | |
| D243,315 | S | 2/1977 | Smith | |
| 4,050,373 | A | 9/1977 | Hellmann | |
| 4,095,521 | A | 6/1978 | Hauptman | |
| 4,128,055 | A | 12/1978 | Hellmann | |
| 4,155,297 | A | 5/1979 | Smith et al. | |
| 4,158,995 | A | 6/1979 | Kaplan et al. | |
| 4,331,074 | A | 5/1982 | Behman | |
| 4,416,197 | A | 11/1983 | Kehl | |
| 4,427,125 | A | 1/1984 | Tuitt | |
| 4,593,615 | A | 6/1986 | Kehl | |
| 4,649,813 | A | 3/1987 | Kehl | |
| 4,682,539 | A | 7/1987 | Bramblett et al. | |

(Continued)

*Primary Examiner* — Jimmy T Nguyen
(74) *Attorney, Agent, or Firm* — Michael Huey, Esq.

(57) ABSTRACT

The invention is a trash compacting device with a handle configured horizontally so a person can grip the handle with the palm of their hand facing downward to maximize compression force and minimize slippage. The frame supports one or more smite plate receivers that may extends horizontally from the frame to increase the distance between center regions of two smite plates. Each smite plate receiver may extends downward at different heights to ensure that bulky trash, such as boxes, does not impede the downward movement of every smite plates. The frame may houses a telescoping tube to ensure ergonomic operations when a garbage can is less than full. Smite plates of different shapes and sizes may be attached to the smite plate receiver to further ensure more uniform compaction of trash. Smite plates and handle grips are pivotally attached to allow for portable transport and compact storage.

6 Claims, 20 Drawing Sheets

(56) References Cited

U.S. PATENT DOCUMENTS

| | | | | | |
|---|---|---|---|---|---|
| 4,991,500 | A | | 2/1991 | Knapp | |
| 5,080,011 | A | | 1/1992 | Paxton et al. | |
| 5,090,309 | A | | 2/1992 | Lai | |
| 5,176,072 | A | | 1/1993 | Larson | |
| 5,363,759 | A | * | 11/1994 | D'Ambrosio | 100/110 |
| 5,619,915 | A | | 4/1997 | Wagner et al. | |
| 5,746,126 | A | | 5/1998 | Huang | |
| 5,797,314 | A | | 8/1998 | Hendrick | |
| 5,845,567 | A | | 12/1998 | Fischer | |
| 5,857,408 | A | | 1/1999 | Witter | |
| 5,862,748 | A | | 1/1999 | Witter | |
| 6,000,323 | A | | 12/1999 | Schlegel | |
| 6,305,278 | B1 | | 10/2001 | Freeberg | |
| 6,415,713 | B1 | * | 7/2002 | Abrams | 100/246 |
| D464,550 | S | | 10/2002 | Seppala | |
| 7,089,853 | B1 | | 8/2006 | Diekleman | |
| 7,237,480 | B2 | | 7/2007 | Ruddock | |
| 7,267,052 | B1 | * | 9/2007 | Streng | 100/265 |
| D636,236 | S | * | 4/2011 | Telford, Jr. | D8/1 |

* cited by examiner

TRASH COMPACTING DEVICE

CROSS REFERENCE TO RELATED APPLICATIONS

This application is related to, and claims priority from U.S. Provisional Patent Application No. 61/364,074 filed on Jul. 14, 2010 by Al Shaw entitled "Trash Compacting Device" the contents of which are hereby incorporated by reference.

FIELD OF INVENTION

The present invention relates a trash compacting device. The invention compresses trash and creates more space in the trash container or trash bag. Consequently, this invention reduces the frequency of trash container emptying. In addition, this invention reduces fuel and workers required to transport trash to a waste management facility.

BACKGROUND OF INVENTION

Trash is a byproduct of residential and commercial activities. A typical garbage can or bag holds a large number of low-density items, such as empty boxes, bottles, and food. Empty containers and low-density materials consume space without adding much weight. Consequently, a garbage can or bag is quickly filled up with hollow items, requiring waste management personnel to dispose of the trash frequently. This increases disposal costs, fuel consumption, wear and tear on local roads and highways.

U.S. Pat. No. 4,427,125 issued on Jan. 24, 1984 to Tuitt claims a food depressor lid to force food towards the bottom of the container. However, the device does not contain a shaft. Therefore, a person must hunch over and reach into a garbage can to compress the food when the garbage can is less than full.

U.S. Pat. Nos. 5,857,408 and 5,862,748 on Jan. 12, 1999 and Jan. 26, 1999, respectively, issued to Witter claims a manual refuse compactor. However, the device contains a shaft as a means to grip the device. Specifically, a person forms a grip with their fingers and thumb that is concentric to the shaft. Consequently, compacting force is loss when the person's hand slides down the shaft, due to an upward force on shaft during the compacting process. Loss of gripping pressure, sweaty hands, or slippery shaft adds to the loss of compacting force.

U.S. Pat. No. D464,550 issued on Oct. 22, 2002 to Seppalla claims an ornamental design for a hand held device for smashing trash. However, like U.S. Pat. Nos. 5,857,408 and 5,862,748, a person's grip must be concentric to the shaft; therefore, parallel to the compacting force moving up the shaft during the compaction process. Consequently, a substantial amount of compacting force is loss when the person's hand slides down the shaft.

U.S. Pat. No. 3,565,351 issued on Feb. 23, 1971 to Ross, Jr. claims an impact tool comprising an handle, shaft, and head for compacting trash. While this device contains a handle that enlarges the shaft to create a better gripping surface, a person's grip is nevertheless concentric to the shaft or handle. Similar to the previously mentioned patents, a substantial amount of compacting force is loss when the person's hand slides down the shaft or handle.

U.S. Pat. Nos. 3,938,731 and 3,946,662 issued on Feb. 17, 1976 and Mar. 30, 1976, respectively, to Ross, Jr. et al. claims a receptacle having a hollow holder, a cover, and a ram. However, the ram is affixed to the cover; therefore, the compacting force must originate from a fixed point. During the compacting process, the force asserted by the ram is not uniformly downward. As the ram pivot about the fixed point, the compacting force is increasingly directed towards the sidewall of a garbage can, especially when the garbage can begins to fill-up. Smashing garbage against the wall, instead of the base of the receptacle causes the receptacle to become unbalanced and tip over; consequently, garbage could fall out of the receptacle and onto the floor.

U.S. Pat. No. 4,155,297 issued on May 22, 1979 to Vigne claims a self-packing container. Similar to U.S. Pat. No. 2,178,797, the device compress garbage against the sidewall of the container. Unless the container is mounted to the floor, asserting a force against the sidewall causes the container to tip over resulting in garbage falling out of the container and on the floor.

U.S. Pat. No. 2,178,797 issued on Nov. 7, 1939 to Vigne claims a bottle breaker with a pestle having a curvature that substantially coincides with the inner edge of a cylindrical container. However, because the pestle is a single plate, it is only suitable to crush glass bottles that fragment into small pieces, creating a level surface after compaction. It is not suitable to compact garbage that does not fragment, such as large boxes, cans, or bottles. Garbage adjacent to the large box, can, or bottles would not receive a uniform compacting force; consequently, the garbage can require more frequent disposal.

U.S. Pat. No. 5,619,915 issued on Apr. 15, 1997 to Wagner et al. claims a manual trash compactor with a rack and pinion gear assembly to increase the amount of compacting force. However, like U.S. Pat. No. 2,178,797, this compactor relies on a single compacting plate that spans the entire perimeter of the garbage can. Consequently, when a bulky item that does not crush easily enters the trash compactor, the compacting plate is blocked by the bulky item, preventing compaction of garbage adjacent to the bulky item.

U.S. Pat. No. 7,237,480 issued on Jul. 3, 2007 to Ruddock claims a manual operated trash compactor that utilizes a lever to assert a force on a single compacting plate. Like U.S. Pat. Nos. 5,619,915 and 2,178,797, the single plate's downward movement is easily blocked by a bulky item that is not easily crushed.

U.S. Pat. No. 6,000,323 issued on Dec. 14, 1999 to Schlegel claims a trash compacting apparatus that utilizes an expandable bladder to assert a force on the trash. While the bladder provides a uniform compacting force, person must carry a remote drive system, e.g., an air compressor, to fill the bladder. Accessing and transporting an air compressor to compact trash is laborious and not practical.

SUMMARY OF THE INVENTION

This invention is a trash compacting device. Unlike other trash compacting devices, this invention is affordable, lightweight, compact, easy to store, and easy to clean. The device is capable of creating more space per bag, depending on the strength of the user and density of the trash. In a preferred embodiment, the invention created approximately 55% more space per bag. In another preferred embodiment, the invention created 65% more space per bag. The amount of compression may exceed 65% under the right conditions. The level of compaction depends on the amount of downward compression force generated by a person and type of trash being compressed. In turn, residents and workers need to empty garbage cans less frequently. As a result, the average home, school, or business saves both time and money to manage waste. Furthermore, this invention saves fuel cost for waste management trucks that pick-up trash. Less frequent waste management truck visits also reduce the wear and tear on local roads or highways.

The present invention relates to a trash compacting device. This invention has a handle that is configured horizontally to allow a person to grip the ergonomic handle with the palm of a hand facing downward. This allows the palm of a hand to assert a downward compacting force on trash, maximizing trash compression force and minimizing grip slippage during the trash compacting process.

In another embodiment, handgrips extending from the ergonomic handle or frame allow for two-handed operation of the trash compacting device. In a preferred embodiment, the handgrips are pivotally attached; therefore, may fold downward into a slot within the frame to conceal the handgrips. This enables the invention to be more portable or compact, facilitating transport or storage.

One or more smite plate receivers extend downward from the frame to increase the overall height of the trash compacting device. In a preferred embodiment, the smite plate receiver may extend downward at different heights to allow for uniform compaction of trash. When a bulky object, e.g., a box impedes the downward movement of one smite plate receiver, the taller smite plate receiver that is not impeded by the bulky object may can reach adjacent garbage, ensuring uniform compacting pressure through the trash bin.

One or more smite plates may be attached to the body of the invention. Increasing the number of smite plates would increase the smite plate surface area to trash ratio. In a preferred embodiment, two or more smite plates provide a more balanced force for trash compacting, when compared with a single smite plate. The interchangeable number and shape of the smite plates attached to each smite plate receiver allows the user to conform this trash compacting device to different types of trash being compacted and different shapes of garbage cans, maximizing the efficiency of this device.

The smite plate may be any geometric shape, such as circular, oval, triangular, rectangular, pentagon, hexagonal, octagonal. In a preferred embodiment, the smite plate is irregularly shaped, such as a foot or hand. In yet another embodiment, the smite plate is X-shaped. In yet another embodiment, the smite plate has a sharp end, point, or barb to pick-up of garbage on the ground.

The distance from the handle to the smite plate vary in length. The length of the invention may be 1 foot to 50 feet. The size of the invention depends on whether the device is used for trash in residential garbage cans or industrial trash compactors. In one embodiment, the distance between the handle and bottom of the smite plate is increased by a telescoping tube or bar. The length of the telescoping tube is controlled by a locking device that fastens or locks the tube to a desire length.

The smite plate attachment means depends on the desired usage, such that the smite plate is foldable, removable, or permanently attached to the smite plate receiver. In a preferred embodiment, the smite plate may pivot from 0 to 180 degrees.

In another embodiment, both the handgrips and smite plates fold to a more compact configuration by pivoting on a hinge to facilitate transport or storage of the invention.

In another embodiment, the invention is hung or attached to the side of a garbage can with the handgrips and smite plates folded to a compact configuration. This allows the invention to be conveniently stored or accessed.

The trash compacting device is portable and easily transported. It is compact and made of lightweight material. The material may contain polymeric, ceramic, wood, metals, or combination thereof. In one embodiment, the device is made of plastic with metal fasteners. In another embodiment, the device is made of wood.

BRIEF DESCRIPTION OF THE DRAWINGS

FIG. 18 demonstrates the smite plate in an unattached configuration.

DETAILED DESCRIPTION OF THE INVENTION

In FIG. 1 to 10, a rectangular shaped handle 10 orientated horizontally to allow a person to grip the handle 10 with the palm of a hand facing downward. This allows the palm of a hand to assert a downward compacting force on trash, maximizing trash compression force and minimizing grip slippage during the trash compacting process.

Figure 11:
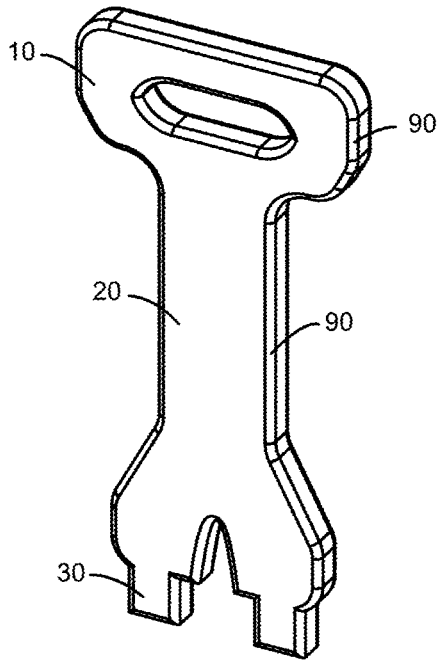
FIG. 11 is a perspective view of a trash compacting device in FIG. 10 with rounded over or fillet edges throughout the trash compacting device.
Figure 12:
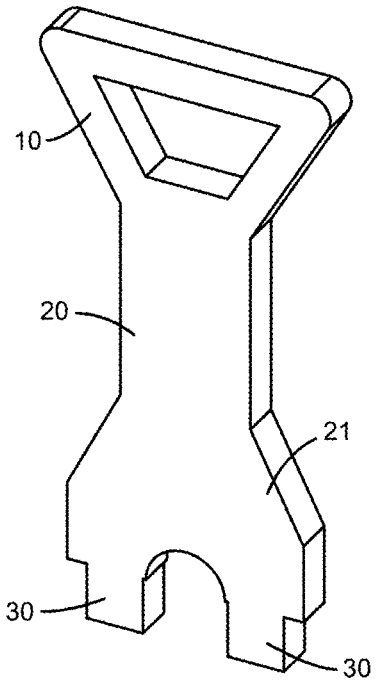
FIG. 12 is a perspective view of a trash compacting device with a trapezoidal shaped handle.
Figure 13:
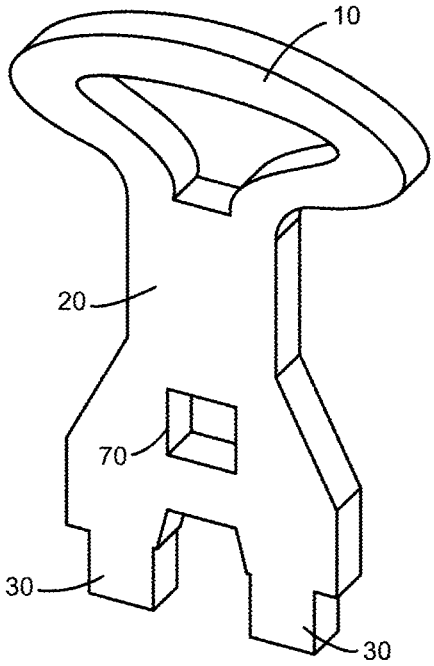
FIG. 13 is a perspective view of a trash compacting device with an oval handle, square extrude cut through the frame, and two elongated smite plate receivers that increase the height of the invention.
Figure 14:
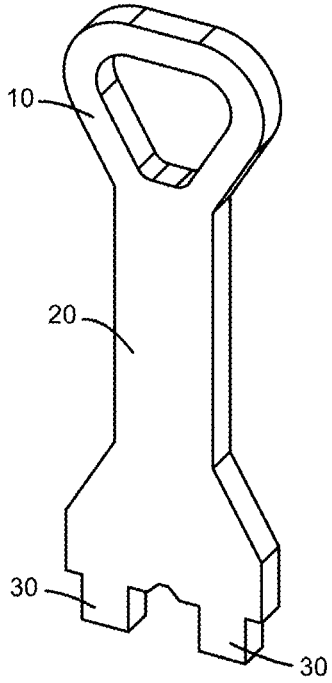
FIG. 14 is a perspective view of a trash compacting device with a narrow handle, rectangular frame, and two elongated smite plate receivers.
Figure 15:
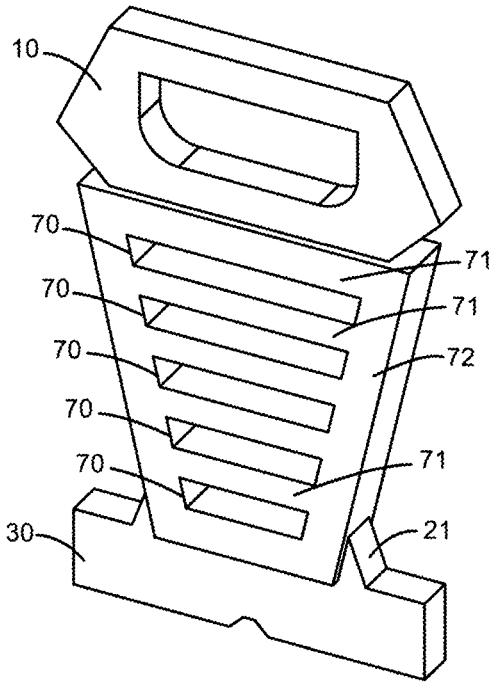
FIG. 15 is a perspective view of a trash compacting device with a wide handle, wide frame, five rectangular shaped extrude cuts, and two smite plate receivers.

In FIG. 11, the handle 10 has a rounded over or fillet 90 edge to provide a smooth griping surface. A chamfered edge is an alternative means to reduce the edge angle. In FIG. 12, the handle 10 is trapezoidal to accommodate a user with thicker or larger hands. FIG. 13 describes an arched shaped handle 10. In this embodiment, the handle 10 has sufficient length to allow two hands to grip the handle 10 comfortably. FIG. 14 describes a handle 10 that is triangular with the internal angles rounded over or fillet 90. FIG. 15 describes a handle 10 with a wide horizontal gripping surface with the bottom corners rounded over or fillet 90.

In FIG. 27 to 30, the handle 10 contains two handgrips 11 allowing for two-handed operation of the trash compacting device. In another embodiment the handgrips 11 folds downward 14 to a vertical configuration, so the handgrips 11 are partially concealed within a slot on sidewalls of the frame 20, enabling the invention to be more portable or compact when transported or stored.

Figure 1:
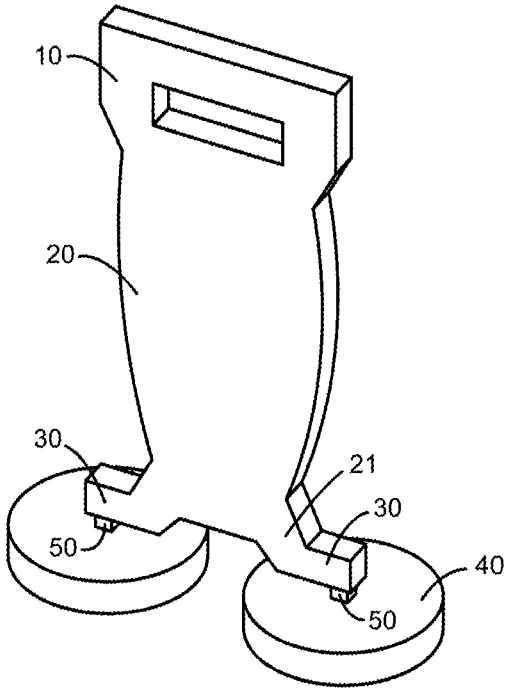
FIG. 1 is a perspective view of a trash compacting device with a ergonomic handle, round frame, and two smite plate receivers, and a circular smite plates fastened to each receiver.
Figure 2:
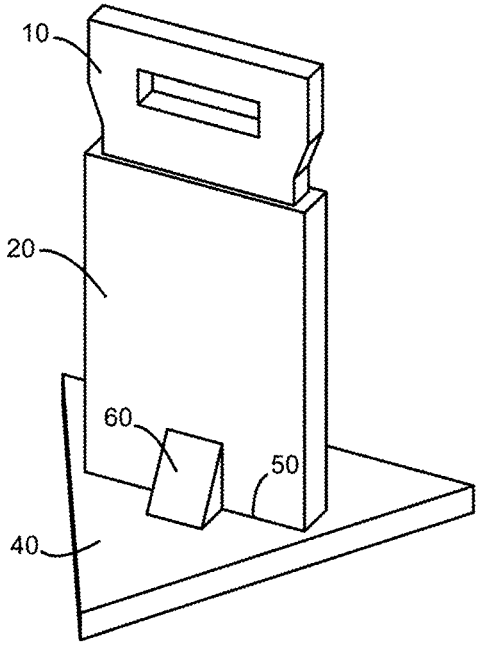
FIG. 2 is a perspective view of a trash compacting device with a horizontal handle, rectangular frame, a smite plate receiver positioned under the frame, and a triangular smite plate with a gusset to reinforce the joint.
Figure 3:
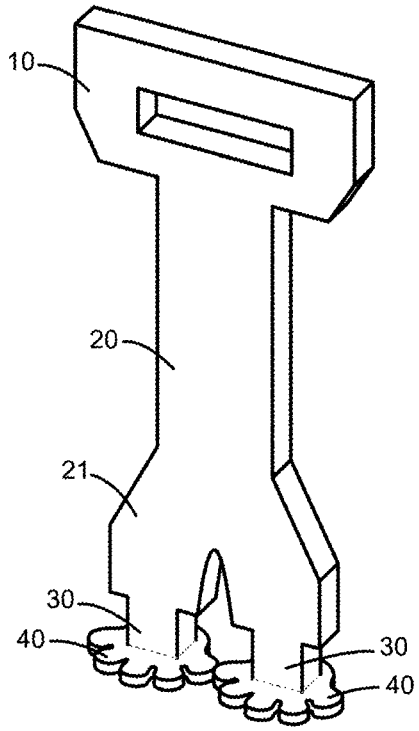
FIG. 3 is a perspective view of a trash compacting device with a horizontal handle, rectangular frame, two smite plate receivers, and two foot-like smite plates.
Figure 4:
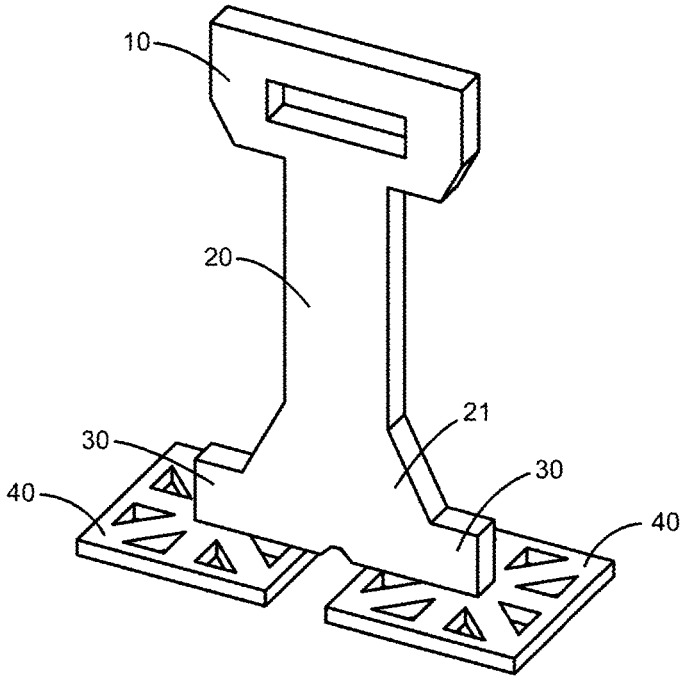
FIG. 4 is a perspective view of a trash compacting device with a horizontal handle, rectangular frame, two smite plate receiver, and two square shaped smite plates with rib support.

Referring to FIG. 1 for a description of a frame 20 with arced edges that connect a handle 10 to a smite plate receiver 30. In FIG. 2, the frame 20 is rectangular with a gusset 60 for reinforcement of the joint between the frame 20 and the smite plate 40. FIG. 1, 3, 4, 6 to 15 demonstrate a Y-shaped 21 frame 20, serving to extend the distance between the centers 41 of two smite plates 40.

Figure 5A:
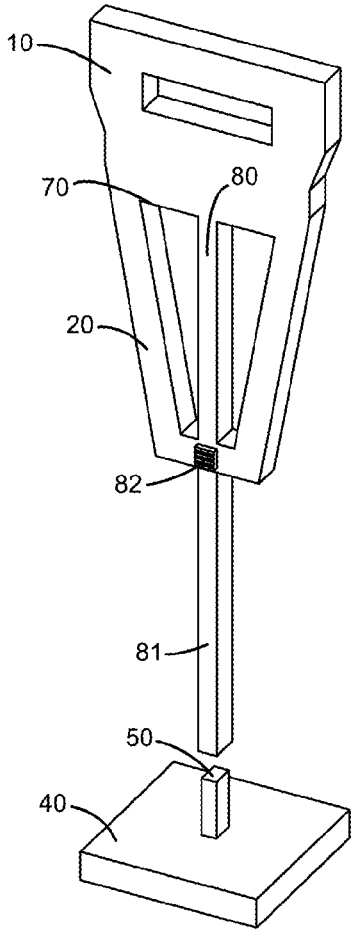
FIG. 5*a* is a perspective view of a trash compacting device with a horizontal handle, elongated telescoping tube, a smite plate receiver with interchangeable smite plate locking mechanism, and a square smite plate.
Figure 5B:
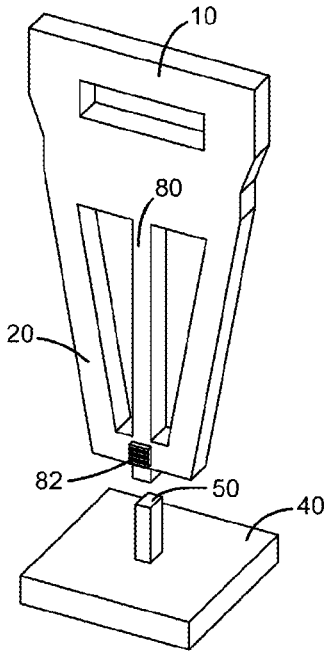
FIG. 5*b* is a perspective view of the trash compacting device in FIG. 5*a* with the telescoping tube in a retracted configuration.

In FIG. 5*a* and FIG. 5*b*, the frame 20 contains a housing 80 for a telescoping tube 81, extendable upon the actuation of a release button 82. FIG. 5*a* demonstrates a telescoping tube 81 in an extended configuration, while FIG. 5*b* demonstrates a telescoping tube 81 in a retracted configuration. The bottom end of the telescoping tube 81 contains a locking mechanism 50 allowing a smite plate 40 to fasten or connect to the telescoping tube 81.

Figure 6:
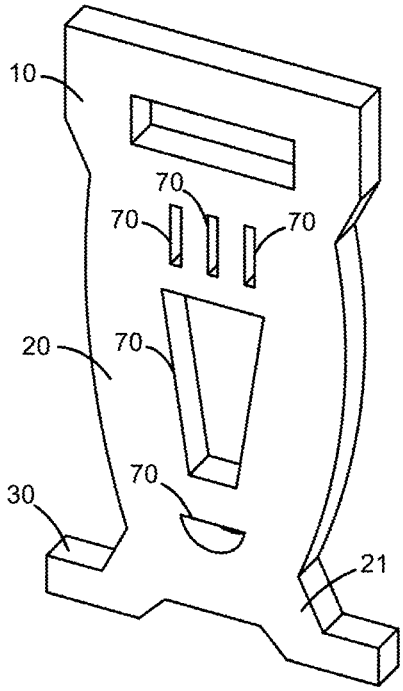
FIG. 6 is a perspective view of a trash compacting device with a ergonomic handle, extrude cuts in the frame, and two smite plate receivers.
Figure 7:
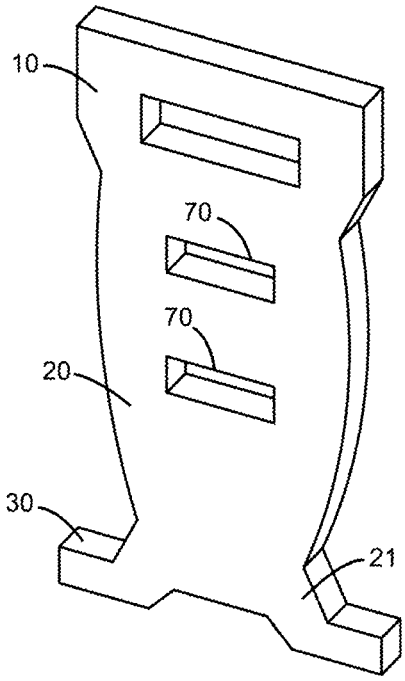
FIG. 7 and FIG. 8 are perspective views of a trash compacting device in FIG. 6 with extrude cuts of different shapes, number, and configurations in the frame of the trash compacting device.
Figure 8:
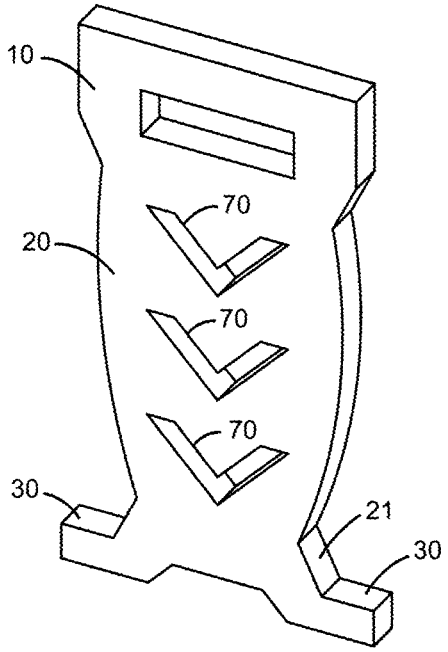
Figure 9:
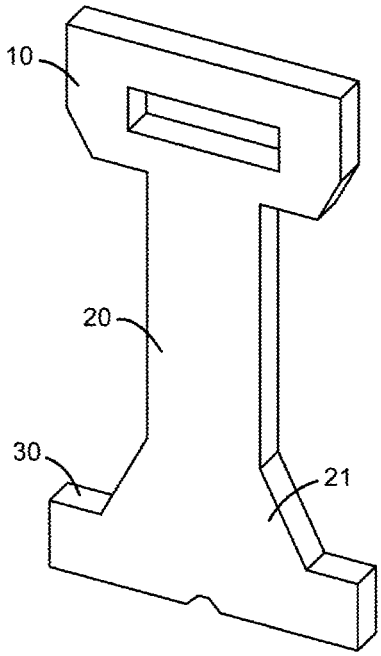
FIG. 9 is a perspective view of a trash compacting device with a horizontal handle, rectangular frame, and two smite plate receivers.
Figure 10:
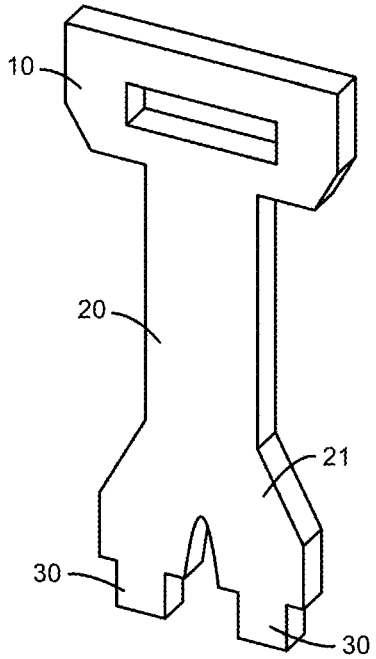
FIG. 10 is a perspective view of a trash compacting device with a horizontal handle, rectangular frame, and two elongated smite plate receivers.

In FIG. 6, the frame 20 contains extrude cuts 70: three rectangular cuts orientated vertically, one trapezoidal, one semi-circular. In FIG. 7, the frame 20 contains two rectangular extrude cuts 70 orientated horizontally. In FIG. 8, the frame 20 contains V-shaped extrude cut 70. In FIG. 13, the frame 20 contains a square shaped extrude cut 70. In FIG. 15, the frame 20 contains five equidistance trapezoidal extrude cuts 70 of varying length to create six rails 71 and two stiles 72 as the frame 20. The number and shape of the extrude cuts 70 are exemplary to demonstrate several configurations where framing material may be eliminated to save production cost while retain structural integrity.

Referring to FIG. 1 for an embodiment with two smite plate receivers 30 connected to a frame 20 of a trash compacting device. In FIG. 2, a single smite plate receiver 30 is connect to the frame 20. In the preferred embodiments, 1 to 10 smite plate receivers 30 were attached to the frame 20. Consequently, one or more smite plates 40 may be attached to the trash compacting device to create uniform compacting pressure on the top surface of the trash. Having more than one smite plate receiver 30 allows the attachment of different types of smite plates 40 to a single trash compacting device. Consequently, this allows the trash compacting device to better conform to the shape of the inner wall of a garbage can 100 or topology of the top surface of the garbage, creating uniform compacting pressure throughout garbage in the garbage can 100.

In FIG. 1, 4, 6 to 9, the smite plate receiver 30 extends horizontally from a frame 20 to increase the distance between center 41 regions of two smite plates 40. FIG. 2 demonstrates a smite plate receivers 30 that does not extend from the frame 20, but rather affixed directly to the bottom of the frame 20. Optionally, a gusset 60 may be added to reinforce the smite plate joint.

In FIG. 3 and FIG. 10 to 15, the smite plate receivers 30 extend downward from the frame 20 to increase the overall height of the trash compacting device. In a preferred embodiment, the smite plate receiver 30 extend downward at different heights to allow for uniform compaction of trash. When a bulky object, e.g., a box impedes the downward movement of one smite plate receiver 30, the taller smite plate receiver 30 that is not impeded by the bulky object can reach the adjacent garbage, ensuring uniform compacting pressure of garbage.

Figure 16:
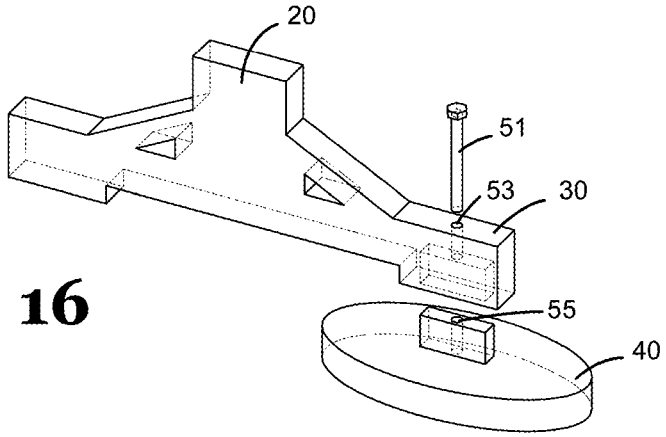
FIG. 16 and FIG. 17 is a perspective view of a smite plate receiver, demonstrating the use of a bolt or wing nut, respectively, to secure interchangeably attached smite plates.
Figure 17:
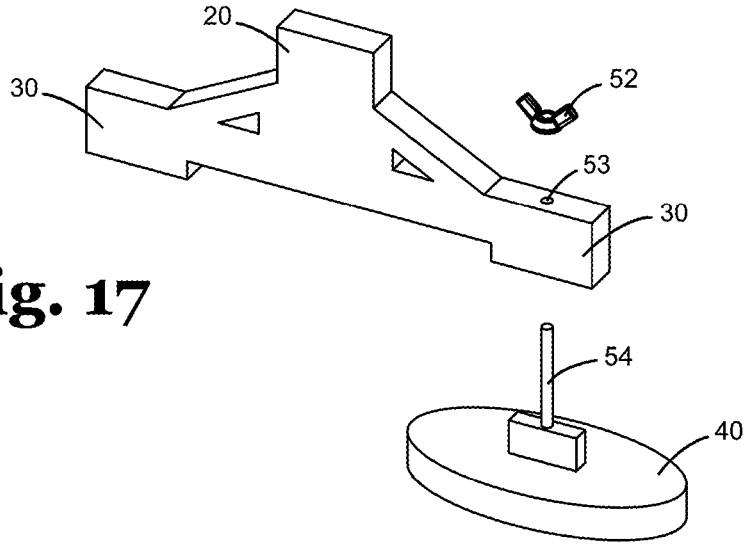
Figure 18:
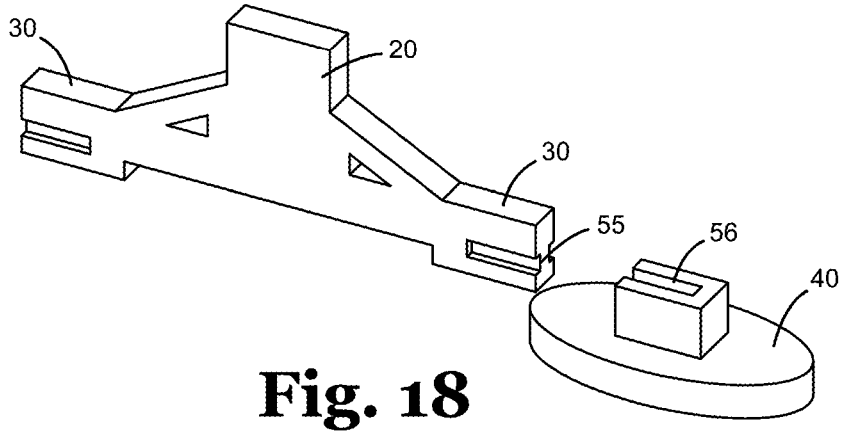
FIG. 18 is a perspective view of a smite plate receiver with dados to join a smite plate.
Figure 19:
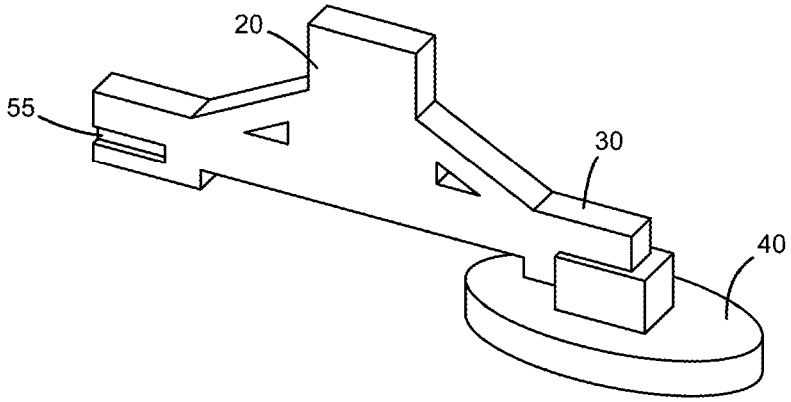
FIG. 19 demonstrates the smite plate in an attached configuration.

In FIG. 16, a semi-transparent view of a smite plate receiver 30 demonstrates a bolt 51 aligned with a hole 53 on a smite plate receiver 30 and a nut 55 affixed to a smite plate 40. A bolt 51 is one of many means to fasten the smite plate receiver 30 to the smite plate 40. FIG. 17 demonstrates the use of a wing nut 52 that may thread onto a rod 54 affixed to a smite plate 40 to fasten the smite plate receiver 30 to the smite plate 40. In FIG. 18, the smite plate receiver 30 has dados 55 for the smite plate grooves 56 to slide and fasten with the smite plate receiver 30. FIG. 19 demonstrates the general appearance of a smite plate 40 with grooves 56 corresponding to the dados 55 on the smite plate receiver 30, when it is fastened or attached to a smite plate receiver 30. Other locking mechanisms 50 known in the art are suitable to join the smite plate 40 to the body of the invention. These include the use of a dowel, pin, clamp, clip, screw, bolt, rivet, fastener, clasp, hook, latch, link, lock and key, adhesive, nail, or weld.

Figure 28:
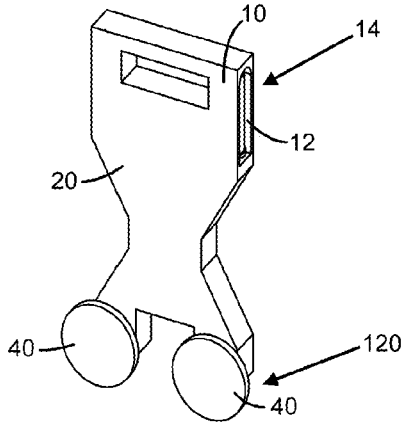
FIG. 28 is a perspective view of a trash compacting device in FIG. 27 with the handgrips and smite plates moved to vertical configuration.
Figure 29:
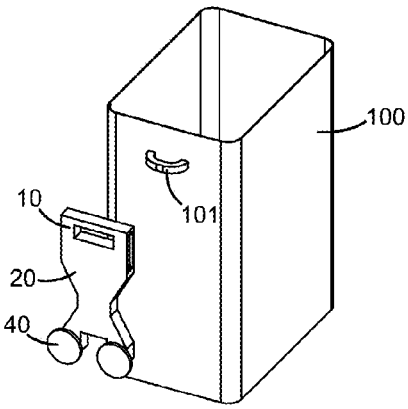
FIG. 29 is a perspective view of the handle of a garbage can that is aligned with the handle of the trash compacting device.
Figure 30:
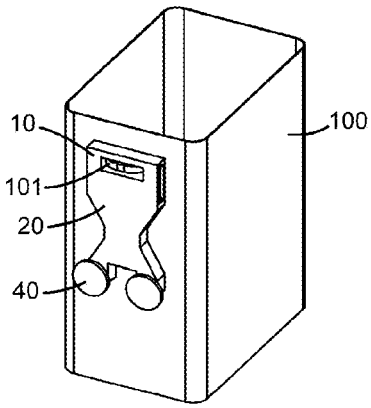
FIG. 30 is a perspective view of a trash compacting device hanging on the garbage can handle as a convenient storage location for the trash compacting device.

In FIG. 27 to 30, a smite plate 40 is locked to a smite plate receiver 30 with a locking mechanism 50 such as a hinge 57, which allow the smite plate 40 to move from a horizontal configuration 110 to a vertical configuration 120. In FIG. 28 to 30 the smite plate 40 is in a vertical configuration 120 to reduce the depth of the trash compacting device, making it more portable and compact for storage. In one embodiment, the hinge allows the smite plate 40 to move from 0 to 180 degrees. Locking mechanisms 50 allows the smite plate 40 to be secured or fixed at different angles during compacting operations and storage. Locking mechanisms 50 known in the art include but not limited to the following: dowel, pin, clamp, clip, screw, bolt, rivet, fastener, clasp, hook, latches, link, lock and key, adhesive, nail, and weld.

Figure 20:
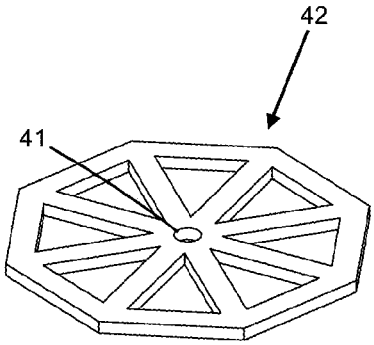
FIG. 20 to 26 are perspective views of a variety of smite plates.
Figure 21:
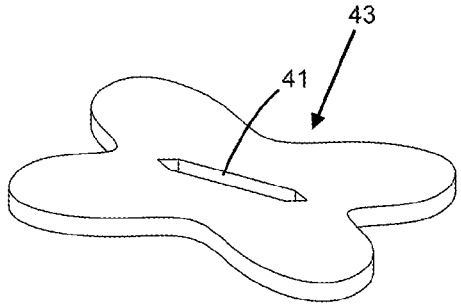
Figure 22:
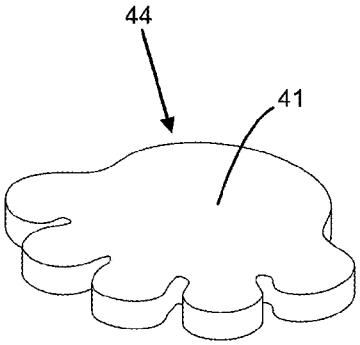
Figure 23:
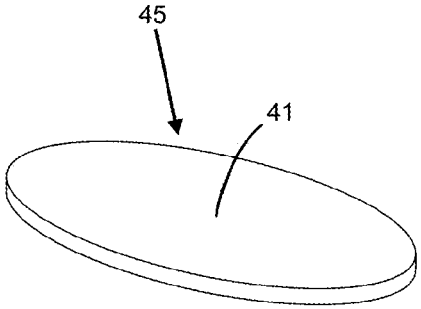
Figure 24:
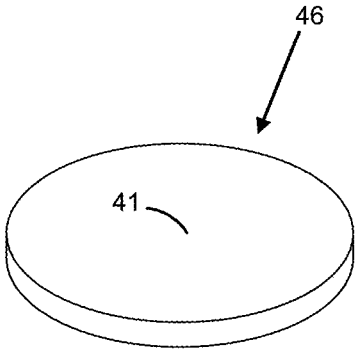
Figure 25:
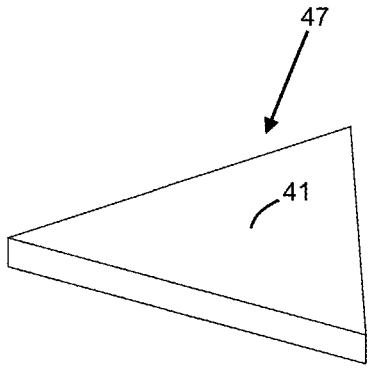
Figure 26:
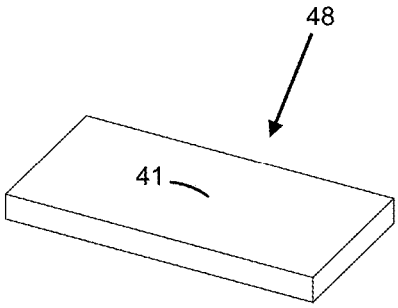
Figure 27:
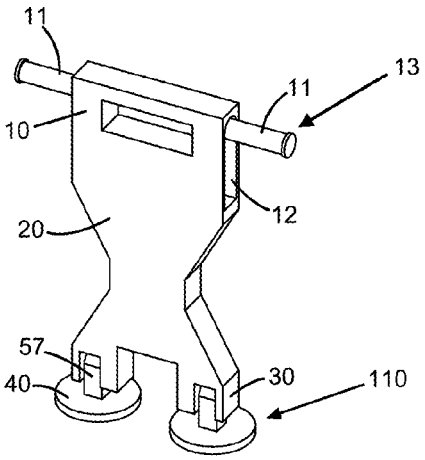
FIG. 27 is a perspective view of a trash compacting device with pivotally attached handgrips and smite plates in a horizontal configuration.

Additional examples of smite plates 40 are provided in FIG. 20 to 26. In FIG. 20, a smite plate 40 is octagon 42 shaped with eight ribs. In another embodiment, spars were added to the smite plate 40. In FIG. 21, the smite plate 40 is X-shaped 43. In FIG. 22, the smite plate 40 is shaped like a hand 44. FIG. 23 to 26 exemplify other geometric shapes, such as oval 45, circle 46, triangle 47, rectangle 48 used in the smite plate 40 design. Smite plate 40 shapes that conform to the shape of the garbage ensure the content in the garbage can

100 does not splash and remain within the garbage can 100 during the compaction process.

In FIG. 28, a trash compacting device has two handgrips 11 in a downward configuration 14 and two smite plates 40 in a vertical configuration 120. In FIG. 29, a trash compacting device handle 10 is aligned with a garbage can handle 101. In FIG. 30, a compacting device is hanging on the garbage can handle 101 for convenient storage and access.

The trash compacting device is made of lightweight material. The material may contain polymeric, ceramic, plastic, polycarbonate, metal, wood, or combination thereof. In one embodiment, the device is made of plastic such as PVC and ABS. In another preferred embodiment, the device is made of wood.

The handle 10 is made of a variety of material that enables a user to hold the invention with minimal grip slippage. The material may contain polymeric, ceramic, plastic, polycarbonate, metals, wood, or combination thereof. In a preferred embodiment, the handle 10 is made of wood. In another embodiment, the handle 10 is made of plastic covered by a rubber grip. In another preferred embodiment, depressions, grooves, or scores were added to the gripping surface of a handle 10 to minimize grip slippage.

It is understood that the preceding descriptions is given merely by way of illustration and various modifications may be made without departing from the spirit of the invention as claimed.

I claim:

1. A trash compacting device comprising:

a. a handle configured horizontally;

b. a frame with a housing;

c. one or more handgrips attached to one or more sidewalls of the frame;

d. a telescoping tube that extends from or retracts into the housing of the frame upon the actuation of a release button;

e. one or more smite plate receivers;

f. one or more smite plates; and g. locking mechanism to fasten the smite plates receivers to the smite plates.

2. The trash compacting device of claim 1, in which said handgrips are pivotally attached to the frame by a hinge, whereby the handgrips are movable between horizontal and vertical configurations, and fastened at said horizontal configuration or vertical configurations by locking mechanisms.

3. The trash compacting device of claim 1, in which the frame has slots on one or more sidewalls to conceal the handgrips when the handgrips are in a vertical configuration.

4. The trash compacting device of claim 1, in which said locking mechanisms include dowel, pin, clamp, clip, screw, bolt, rivet, fastener, clasp, hook, latch, link, lock and key, adhesive, nail, or weld.

5. The trash compacting device of claim 1, in which said smite plate is circular, oval, triangular, square, rectangular, X-shaped, hand-shaped, or foot-shaped.

6. The trash compacting device of claim 1 is made of lightweight material such as polymeric, ceramic, plastic, polycarbonate, metal, wood, or combination thereof.

* * * * *